US005761942A

United States Patent [19]

Johnson et al.

[11] Patent Number: 5,761,942

[45] Date of Patent: Jun. 9, 1998

[54] APPARATUS AND METHOD FOR THE EMBOSSING OF CONTAINERS

[75] Inventors: Brian D. Johnson, Sinclairville; Randall E. Carr, Ellicottville; Larry W. Ellis, Cattaraugus, all of N.Y.

[73] Assignee: Aluminum Company of America, Pittsburgh, Pa.

[21] Appl. No.: 694,713

[22] Filed: Jul. 19, 1996

[51] Int. Cl.[6] ..... B21D 51/26

[52] U.S. Cl. ..... 72/94; 72/105

[58] Field of Search ..... 72/17.3, 37, 105, 72/106, 379.4, 420; 74/392, 409; 101/7, 23; 220/671, 674

[56] References Cited

U.S. PATENT DOCUMENTS

| | | | |
|---|---|---|---|
| D. 283,011 | 3/1986 | Moloney et al. | D9/398 |
| D. 290,688 | 7/1987 | Moloney et al. | D9/398 |
| 744,231 | 11/1903 | Puddefoot | 72/105 |
| 2,630,204 | 3/1953 | Lichtenberg | 198/33 |
| 3,048,512 | 8/1962 | Nelson | 156/14 |
| 3,126,309 | 3/1964 | Manas et al. | 156/566 |
| 3,221,643 | 12/1965 | Rudolph et al. | 101/7 |
| 3,359,819 | 12/1967 | Veillette et al. | 74/409 |
| 4,266,685 | 5/1981 | Lee, Jr. | 220/74 |
| 4,399,675 | 8/1983 | Erdmann et al. | 72/37 |
| 4,487,048 | 12/1984 | Frei | 72/105 |
| 4,519,232 | 5/1985 | Traczyk et al. | 72/133 |
| 4,773,718 | 9/1988 | Weitzen et al. | 350/3.61 |
| 4,814,784 | 3/1989 | Pallmeyer | 343/882 |
| 4,854,442 | 8/1989 | Krooss | 198/400 |
| 4,954,044 | 9/1990 | Chizaki | 414/754 |
| 5,201,984 | 4/1993 | Bedin | 156/566 |
| 5,255,775 | 10/1993 | Buehren et al. | 198/395 |
| 5,261,261 | 11/1993 | Ramsey | 72/105 |
| 5,261,558 | 11/1993 | Claydon | 220/671 |
| 5,349,837 | 9/1994 | Halasz et al. | 72/94 |
| 5,360,314 | 11/1994 | Provost et al. | 414/755 |
| 5,397,021 | 3/1995 | Usui | 220/667 |

FOREIGN PATENT DOCUMENTS

| | | | |
|---|---|---|---|
| 0572758 | 3/1992 | European Pat. Off. . | |
| 41 40 428 | 6/1993 | Germany | 72/37 |
| 4367432 | 12/1992 | Japan . | |
| 247637 | 2/1926 | United Kingdom | 72/105 |
| 1 408 091 | 10/1975 | United Kingdom | 72/105 |

*Primary Examiner*—Lowell A. Larson
*Attorney, Agent, or Firm*—Thomas R. Trempus

[57] ABSTRACT

A can body embossing apparatus has a first mandrel with a first tooling member adapted to receive thereon a can body and a second mandrel with a second tooling member reciprocally movable from a first position distal the first tooling member to a second position proximate the first tooling member. In the second position, the can body side wall is engaged between the first tooling member and the second tooling member. The first tooling member defines one or more recessed portions therein and the second tooling member defines one or more protuberances extending therefrom and adapted to correspond with the recessed portions. The first mandrel and second mandrel are in mechanical communication throughout the reciprocal movement of the second mandrel such that the first and second tooling members rotate continuously with respect to each other and maintain a substantially constant relative position with respect to each other. The continuous side wall of the can body is conveyed between the first and second tooling members to effect the embossing of the side wall resulting in the formation of decorative embossed features in the side wall.

10 Claims, 10 Drawing Sheets

APPARATUS AND METHOD FOR THE EMBOSSING OF CONTAINERS

FIELD OF THE INVENTION

This invention relates generally to two-piece containers typically used in the beer and beverage industry, and more particularly to an apparatus for the embossing of such containers to enhance their appearance.

BACKGROUND OF THE INVENTION

A two-piece container of the type used in the beer and beverage industry consists of a unitary body and a can end. The unitary body is typically formed through a drawing and ironing process. The can end typically consists of an end shell that is converted into an easy open style end. After the can body is filled with a product the converted end is seamed onto the open end of the body. Two-piece cans are predominantly formed from aluminum sheet product and are the most common type of metal container employed by the beer and beverage industry. Of critical importance in the packaging industry is the desire to enhance the appearance of the container in order to achieve a heightened level of package/product differentiation and consumer acceptance.

Various attempts have been made to enhance the overall appearance of the two-piece drawn and ironed aluminum container. These attempts have been two pronged. On the one hand, various efforts have been made to increase the appearance of the decorated can through the use of additional colors in the graphic art applied on the can body. For example, the decoration of cans has gone from four colors to six colors and now presently to eight different colors that can be applied by a single can body decorator apparatus. On the other hand, efforts have been made to modify the appearance of the container itself by further forming or shaping of the can body itself. For example, it is known to produce a fluted appearance in the side wall of a can body such as disclosed in U.S. Pat. Nos. Des. 283,011 and Des. 290,688. A method and apparatus for processing containers to produce the designs illustrated in the aforementioned patents is disclosed in U.S. Pat. No. 5,349,837, the contents of which are incorporated herein by reference as if fully set forth.

However, there remains in the industry a desire to improve the appearance of can bodies in such a way that features formed in the side wall retain their form even when the contents of the container are under pressure. For example, when a can body having a fluted side is pressurized, the fluted appearance on the consumer side of the container is lessened and the overall fluted appearance of the container diminished. The full impact of the fluted side wall may not be realized until the beverage container is opened and internal pressure equalized with the ambient.

It is therefore a desire in the industry to provide a method for enhancing the appearance of a can body, such that the can body retains the features even when the can's contents are maintained under pressure.

It is therefore an object of this invention to provide an apparatus for the embossing of a can body side wall to enhance the appearance of the container.

It is also an object of the apparatus of this invention to provide a can body having features thereon that maintain their integrity even when the contents of the container are maintained under pressure.

It is still another object of this invention to provide an apparatus that can be readily integrated into a commercial can line to provide the selective embossing of a decorated can body.

SUMMARY OF THE INVENTION

According to the present invention, the body portion of a two piece container is further formed to incorporate a variety of features embossed on the side wall of the container body. According to one aspect of the instant invention, the can body side walls are embossed in a continuous process by means of an apparatus that includes a turret that is mounted for fixed rotation on a support column. The turret has a plurality of substantially identical embossing stations circumferentially disposed around the periphery of the turret. The turret rotates about the column, sequentially conveying each work station from a can body acquisition station, through loading, embossing, and unloading operations during a portion of the rotational travel of the turret, and finally to a can body discharge station. The can body is delivered to and removed from the apparatus of this invention by means of conventional conveyance systems.

Each embossing station includes a first mandrel supported for rotation about a fixed axis and a second mandrel supported for rotation about a reciprocating, second axis. The second axis reciprocates between a first location proximate the first axis and a second location distal the first axis in a manner to be described below. The reciprocal movement of the second mandrel is controlled by a cam mechanism disposed on the support column. Each embossing station incorporates a pair of tooling members, each associated with one of the first or second mandrels, one of the pair of tooling members being a female member, the other a male member. The tooling member associated with the first mandrel constitutes the inner tooling member, in that during the embossing operation, the can body substantially encapsulates it. The inner tooling member is in contact with the product side of the container's side wall. Preferably, the inner tooling also constitutes the female tooling member. The tooling member associated with the second mandrel constitutes the outer tooling member, in that during the embossing operation it is in contact with the consumer side of the container's side wall. This outer tooling member constitutes the male tooling member. The inner and outer tooling members when in the first position proximate each other, are sufficiently close so that rotating tooling members engage the continuous side wall of the can body, initiating the embossing of the can body according to the apparatus of this invention. The tooling members are rotated approximately one full revolution (360°) in order to further form substantially the entire continuous side wall.

Turning to the apparatus, the rotational movement of the first mandrel is provided by a spur gear fixedly attached to the mandrel and riding along a sun gear fixed on the column. As the turret conveys the work station about the column, the first mandrel spur gear, which is rotating about its axis is in contact with sun gear. Preferably, the gear ratio between the first mandrel spur gear and the column sun gear is such that for one complete revolution of the turret about the column, each mandrel completes three complete rotations about its axis. The first and second mandrels are in mechanical communication with each other so as to be continuously rotating at a substantially constant speed and in a synchronized relationship with respect to each other. This synchronized relationship is maintained while the second mandrel reciprocates between the first and second position through a combination of the first mandrel spur gear and an anti-backlash spur gear fixedly attached to the second mandrel. The anti-backlash gear includes a spring-loaded split face that is biased to urge one face of the gear into misalignment with the other face. This "forced misalignment" maintains the teeth of the anti-backlash gear of the second mandrel in continuous contact with the teeth of the spur gear of the first mandrel even as the second mandrel moves away from and then back into working engagement with the first mandrel.

The continuous contact of the gears maintains the first mandrel and the second mandrel in a synchronized, rotational position with respect to each other.

Both the fixed and the movable mandrel support a tooling member thereon. When the second mandrel is in the first position proximate the first mandrel, both tooling members are positioned to be in contact with a can body that has been loaded onto the first mandrel tooling. In this condition, the tooling of both the first and second mandrel are able to further form the can body. When the second mandrel is in the second position distal the first mandrel, sufficient clearance is provided between the two tooling members to facilitate the loading and unloading of the can body onto and from the tooling.

Each working station also includes a loading mechanism that is in axial alignment with the first mandrel. The loading mechanism is axially reciprocated between a first, can acquisition elevation or position and a second elevation for loading and unloading the acquired can body onto and off of the first mandrel tooling member. Cam follower means are provided on the lower end of the loading mechanism and a can body support platform is disposed on the upper end of the loading mechanism. The cam follower means travels along a lift cam circumferentially disposed about the base of the column causing the loading mechanism to reciprocate between the first and second elevations. The can body support platform includes a vacuum means for positively engaging the bottom or dome portion of the can body while the loading mechanism is conveyed about the support column and is reciprocated between elevations.

In operation, as the turret conveys a work station about the support column, the loading mechanism support platform, at a first or lower elevation acquires a can body at the can body loading station. The can body is retained on the support platform by vacuum that maintains the can body in axial alignment with respect to the first mandrel tooling member. The loading mechanism, by means of the cam follower, lifts the can body up to the second elevation, inserting it over the first mandrel tooling. Thus, the first mandrel tooling member is engaged with the product side of the side wall of the container. The second mandrel is reciprocated to the first position proximate the first mandrel. The second mandrel tooling is now engaged with the consumer side of the side wall of the container. The second mandrel remains in the first position for approximately one complete rotation of both mandrels about their respective axes, then reciprocates to its second position distal the first mandrel. The can body is removed from the first mandrel tooling, preferably by means of air pressure supplied through a bore at or near the axis of the first mandrel. The loading mechanism re-engages the bottom of the can body, preferably with the benefit of a vacuum system and lowers the can body to the first elevation. The turret continuing its rotation about the column positions the loading mechanism at a can body discharge station. It should be appreciated that the turret is supplied with a plurality of embossing stations, preferably twelve to twenty-four individual stations, so that each rotation of the turret can further form multiple can bodies in a continuous operation.

BRIEF DESCRIPTION OF THE DRAWINGS

The above as well as other features and advantages of the instant invention can be appreciated through consideration of the detailed drawings in which.

DETAILED DESCRIPTION OF A PREFERRED EMBODIMENT

Figure 1:
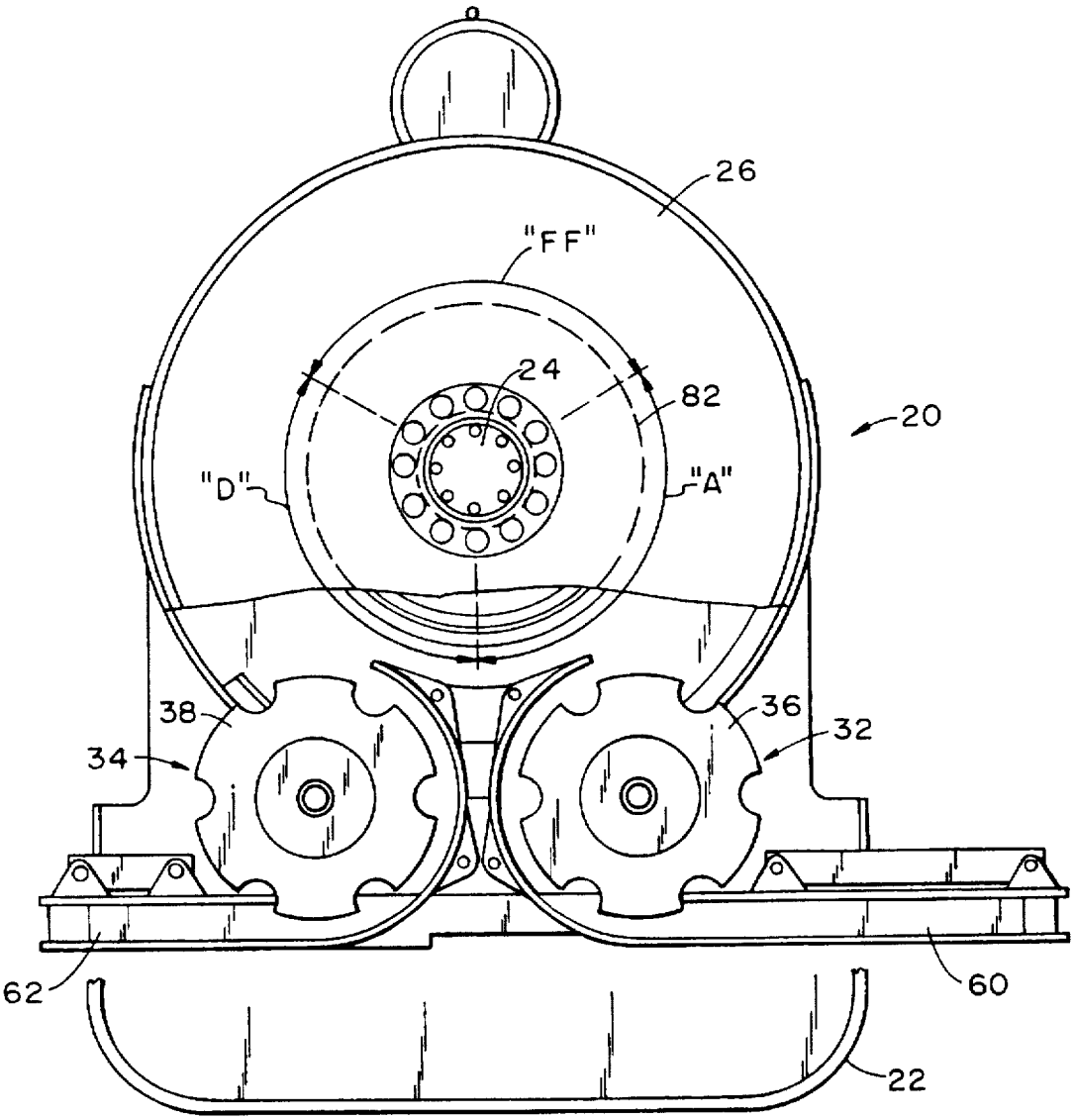
FIG. 1 is a plan top view with parts thereof broken away showing the processing apparatus constructed in accordance with the present invention.
Figure 2:
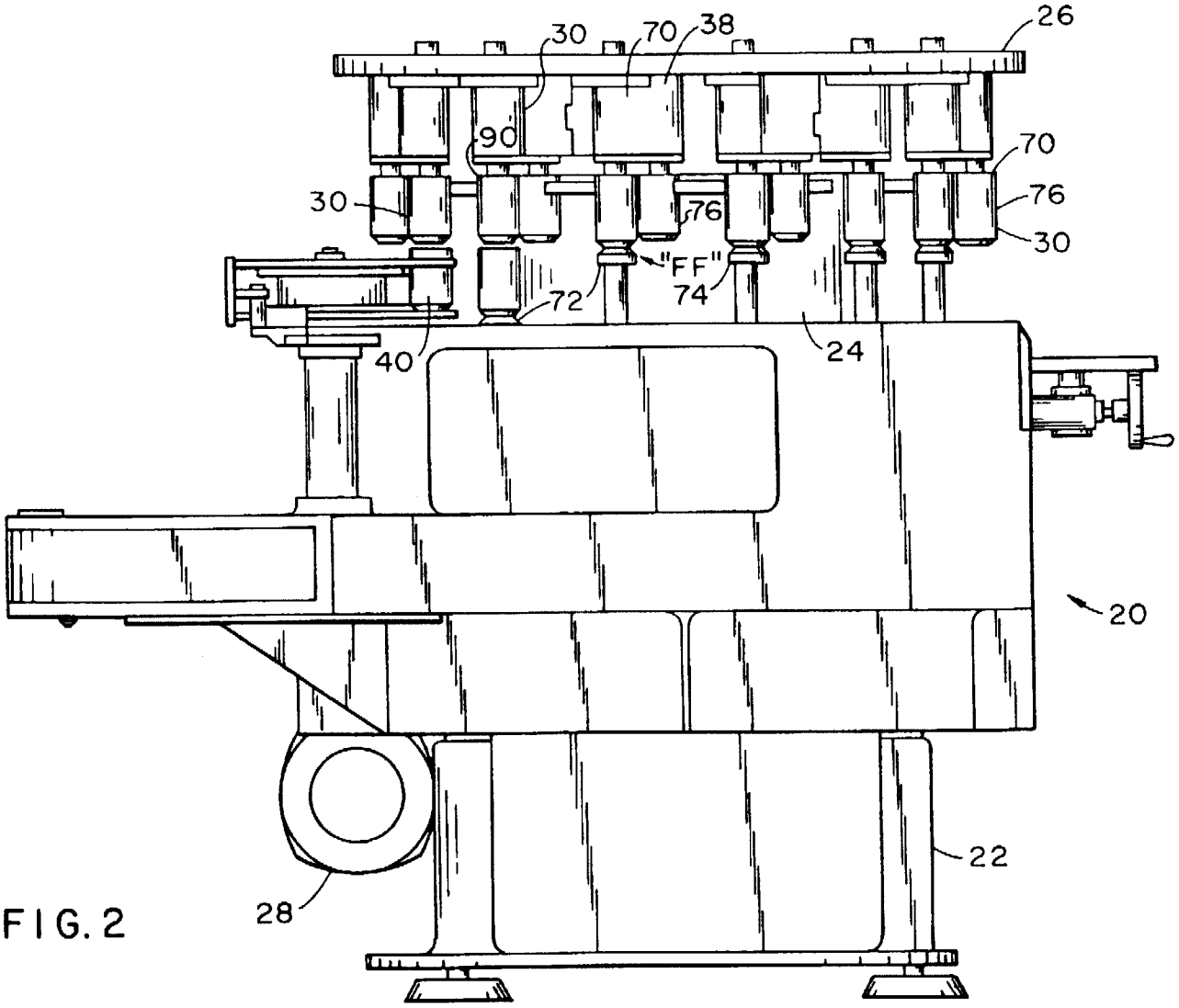
FIG. 2 is a side elevation view of the apparatus shown in FIG. 1.

FIGS. 1 and 2 illustrate in top plan and side elevation view, respectively, a container processing apparatus generally designated by the reference character 20. The apparatus 20 consists of a base 22 that has a center post or column 24 on which is supported a rotatable turret 26. The turret 26 is rotated about the center column 24 through a conventional drive means 28 mounted on the base 22. The turret 26 has a plurality of substantially identical processing stations 30 mounted about the periphery thereof. Preferably, the turret includes between twelve and twenty-four such stations. However, the number of stations can be readily increased or decreased to accommodate production efficiencies.

Figure 3:
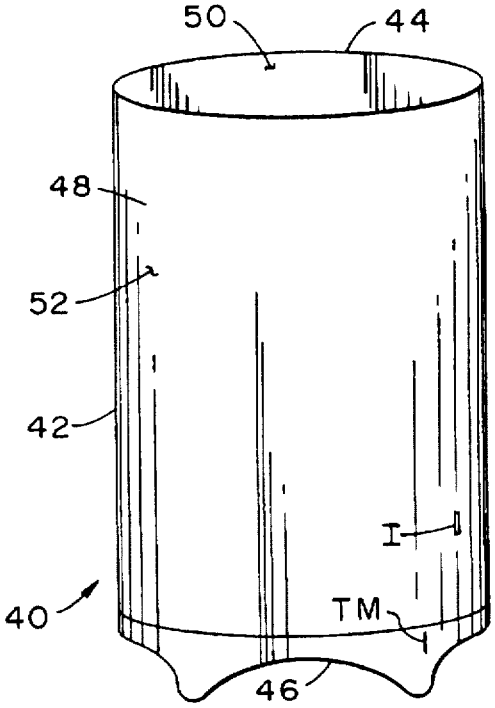
FIG. 3 is a side elevation view of the can body portion of a conventional two piece beer and beverage container prior to the application of the embossing or embossing process of the present apparatus.

Turning to FIG. 3, a conventional can body from a two piece beverage container that is well suited for embossing in the apparatus of this invention is generally indicated by the reference character 40. The container 40 consists of a can body portion 42 with an open end 44. The body portion 42 includes a bottom portion 46 and a continuous side wall 48 having a beverage side 50 and a public side 52.

The can body or container 40 is delivered to the processing apparatus 20 through an infeed mechanism 32. In a conventional can manufacturing line, the present apparatus can be positioned such that the can body is subject to the embossing process of this invention prior to the necking and flanging operations. The containers are removed from the processing apparatus subsequent to embossing through a discharge mechanism 34. The infeed mechanism 32 can incorporate a conventional star wheel mechanism 36 or the like that has a plurality of periphery pockets for receiving containers from a continuously moving conveyer 60 for delivery to each of the embossing stations 30. The discharge mechanism 34 can include a second star wheel mechanism 38 or the like that also has pockets for receiving the further formed containers from each of the stations for ultimate delivery to the continuously moving conveyor 62. The further formed cans are transported for further processing and filling in the can line.

As shown in FIGS. 1 and 2 each station 30 incorporates a first or fixed mandrel 70, a loading mechanism 72, and a second or moveable mandrel 76. The loading mechanism 72 includes a loading platform 74 which is vertically reciprocated within an opening in the turret 26 through a lift cam located along the base of the system. As the turret conveys an embossing station 30 through the can acquisition and ultimately can discharge positions, the loading mechanism platform 74 is maintained at a first elevation. The portions of the rotational travel of the turret through which the platform is maintained at the first elevation are typically the first and last 120 degrees of travel of the turret. As shown in FIG. 1, the acquisition zone of turret travel is generally indicated by the character "A" and the discharge zone of the turret is generally indicated by the reference character "D". The remaining approximately 120 degrees of rotational travel of the turret 26 are characterized as the embossing zone "FF". It will be appreciated that through a modification of the lift cam and an adjustment of the revolutions that the first mandrel makes per single revolution of the turret about the column, the dimensions of the several zones can be expanded or contracted. While an embossing station is traversing the embossing zone (FF in FIG. 1), the platform is elevated from the first position and maintained at a second higher elevation to accomplish the loading, forming, and unloading functions. In other words, the lift cam maintains the platform at a first elevation at the can acquisition and can discharge stations and sequentially raises and then lowers the platform up to and down from a second elevation for the embossing of the can body.

Figure 4:
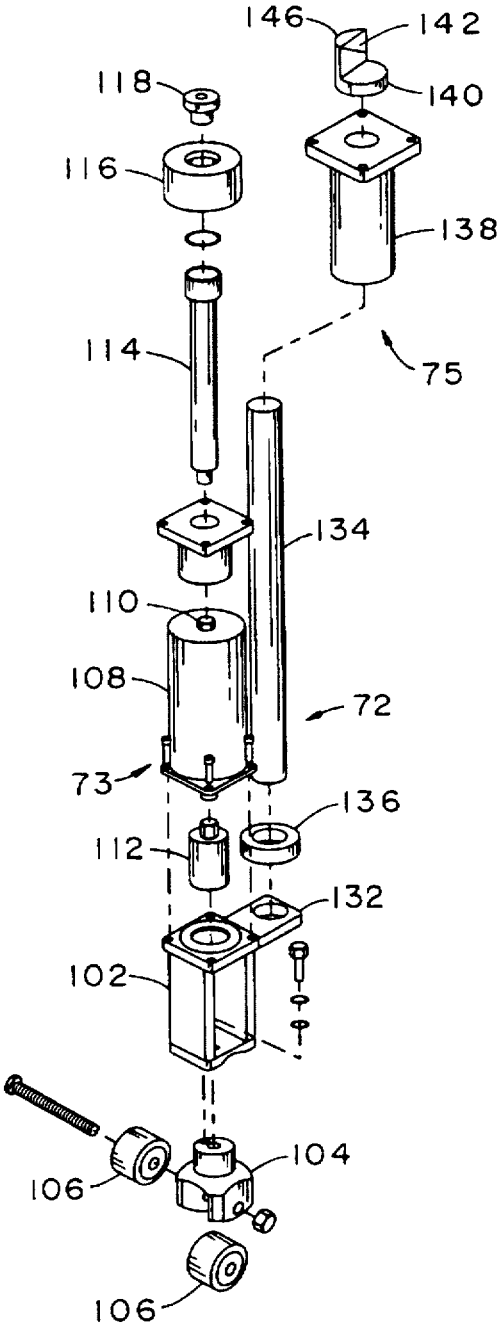
FIG. 4 is an side elevation, exploded view of a can body lifting mechanism.

Considering FIG. 4, the loading mechanism 72 consists of a lift rod 102 having a lower end on which is mounted a lower lift rod support mechanism 104. A cam follower 106 is mounted for rotational movement in the lower lift rod support mechanism 104. The top of the lift rod 102 supports a loading platform 74. A union 112 provides a means for applying a vacuum through a passage 110 terminating at a vacuum orifice 116 in the center of the loading mechanism or lift pad 74. The loading mechanism or lift pad has a surface adapted to facilitate the seating of a container body thereon in such a way as to promote axial alignment with the fixed mandrel 70.

Thus a container is delivered from a feed mechanism 32 to a loading mechanism 72 while the loading platform 74 is in the first or lowered position. As the platform is elevated, the can body is mounted onto a tooling member 90 of the first or fixed mandrel 70. A mechanism for moving the platform 74 between the two desired elevational positions may be of the type shown in U.S. Pat. No. 4,519,232 incorporated herein by reference as if fully set forth.

Figure 5:
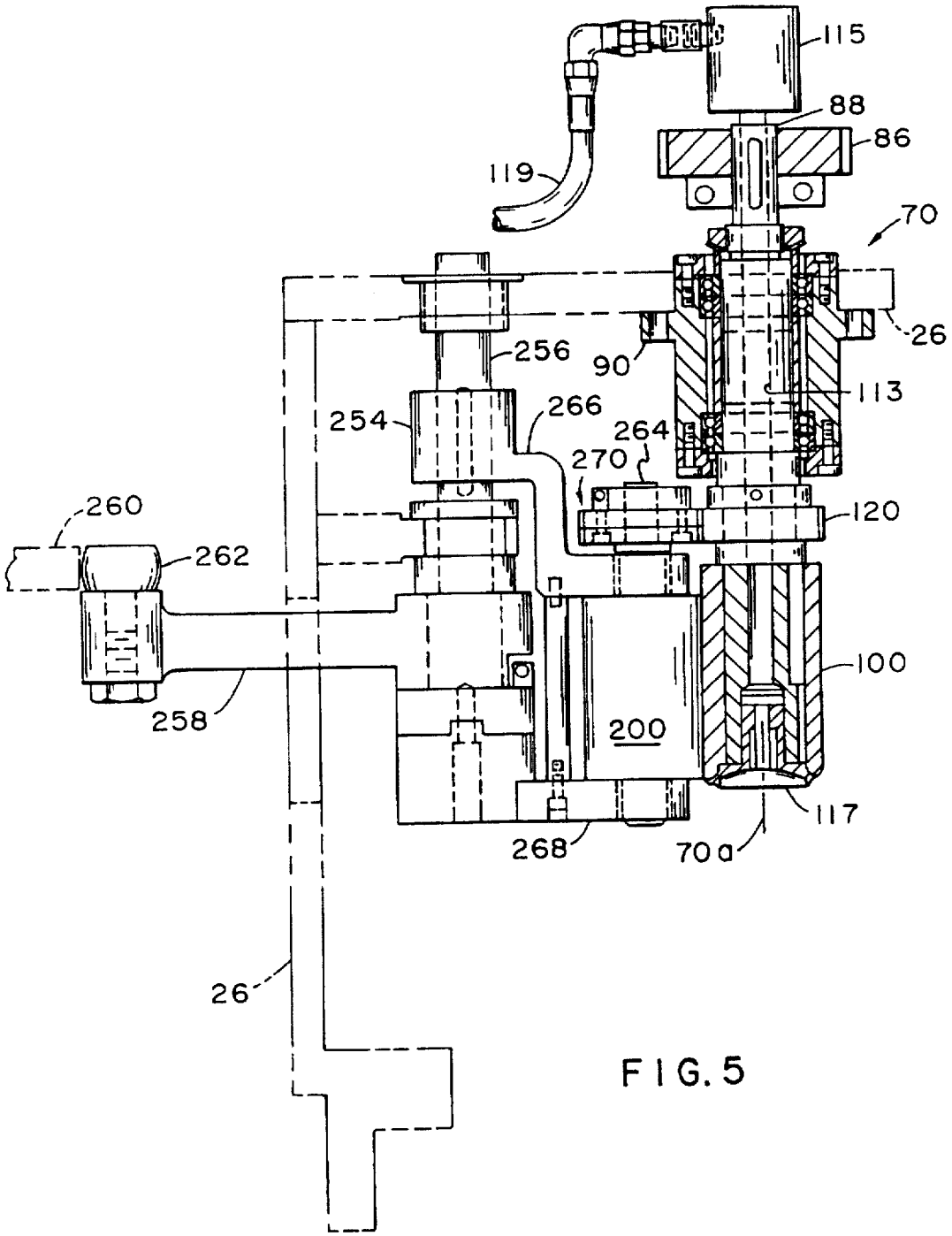
FIG. 5 is a side elevation view of the fixed and movable mandrels of this invention with portions shown in section.
Figure 6:
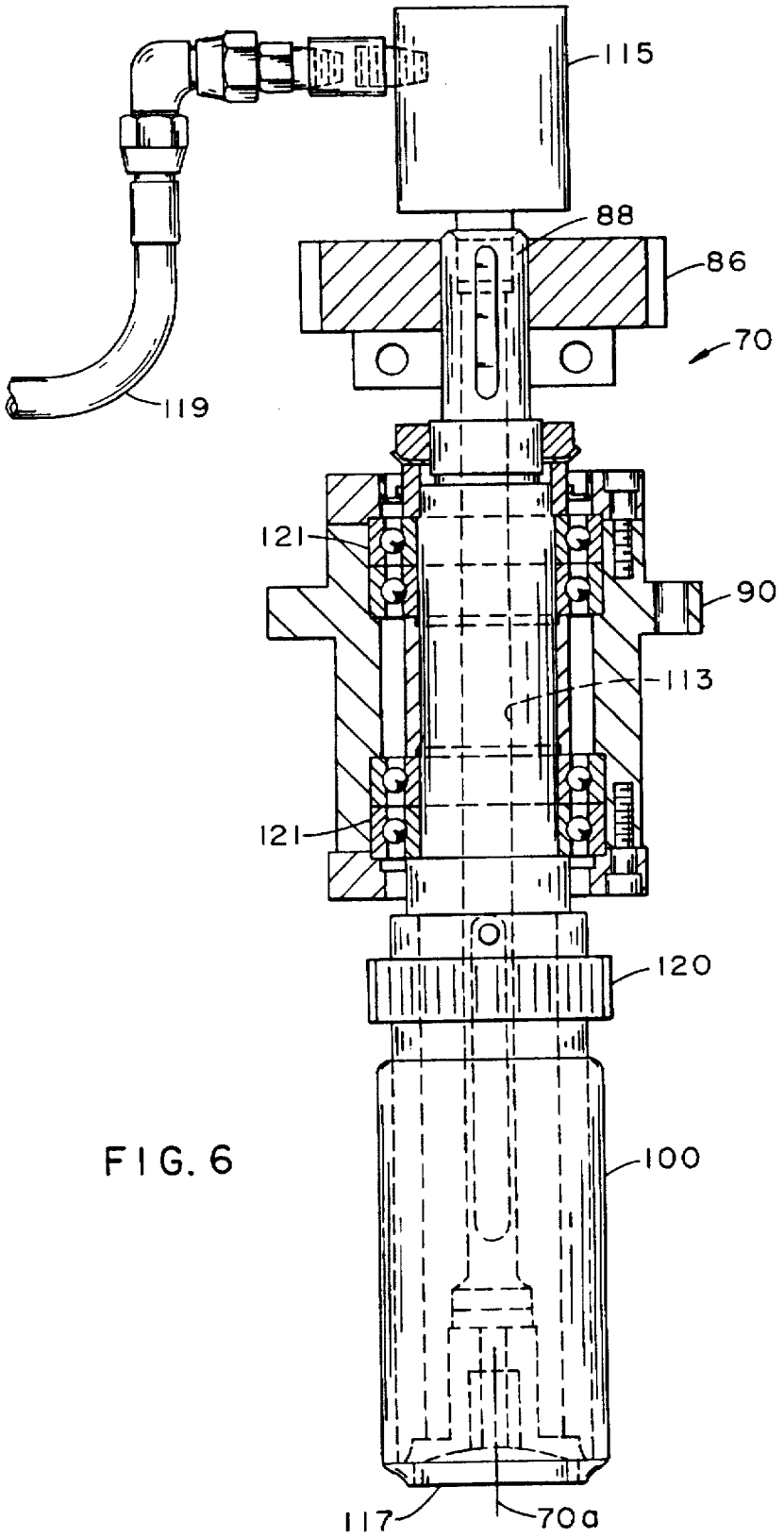
FIG. 6 is a side elevation view of the fixed mandrel with portions shown in section.
Figure 7B:
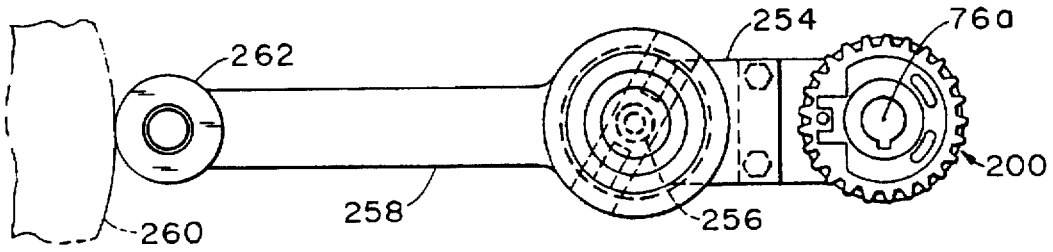
FIGS. 7A and 7B are a side elevation view and a plan view of the movable mandrel of this invention with portions shown in section and in phantom.
Figure 7A:
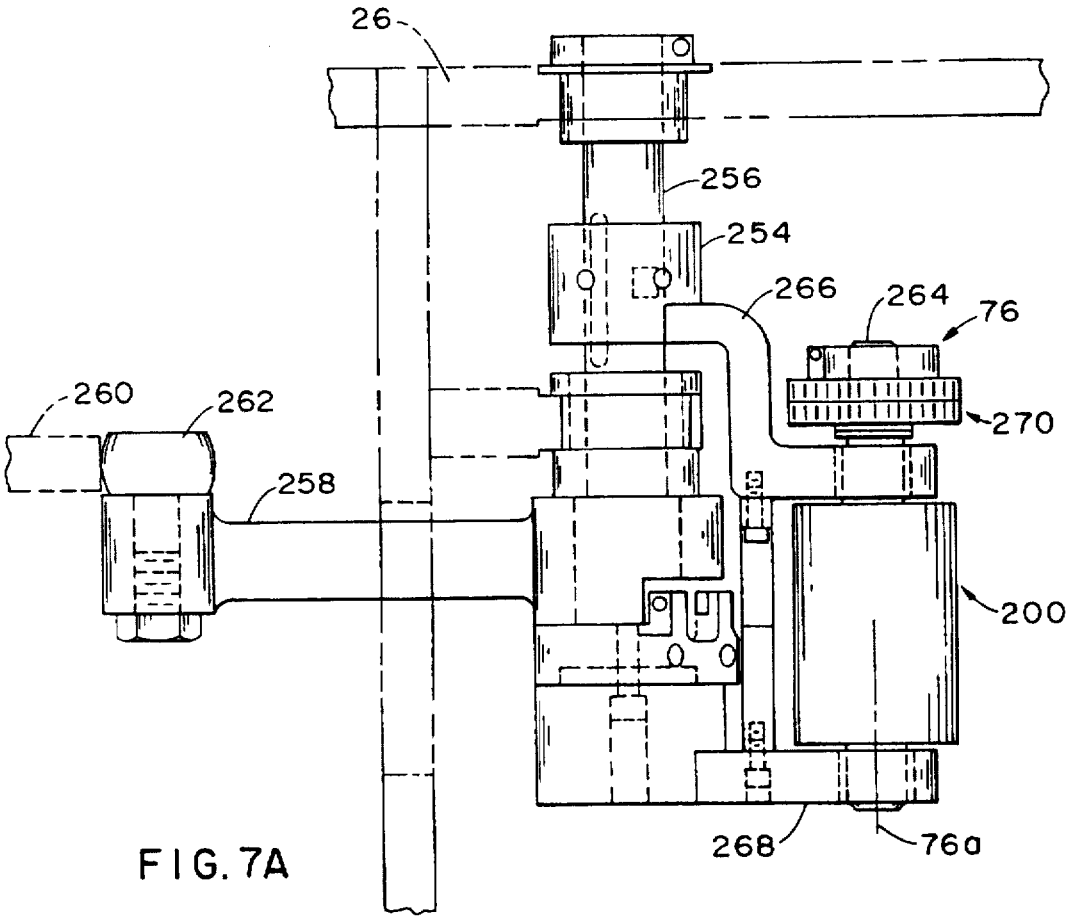

A first or fixed mandrel 70 and a second or reciprocating mandrel 76 are shown in detail in FIGS. 5, 6, and 7. Each mandrel supports its own tooling member which together work in concert to emboss the side walls of a container body. The fixed mandrel 70 is mounted for rotation about an axis 70*a* that is directly above and in alignment with the lift pad assembly 72. The first mandrel 70 is rotationally driven about its fixed axis by means of a gearing system. The gearing system consists of a first fixed or sun gear 82 that is mounted on the column 24 (See FIG. 1), and a second fixed or planetary gear 86 fixedly mounted onto the shaft 88 of the mandrel 70. The shaft 88 is rotationally mounted in the housing 90 that is mounted (not shown) onto the turret 26. This arrangement creates a planetary gear drive system in which each embossing station has a planet gear that is driven by the fixed sun gear 82 as the turret rotates about the column. The mandrels, which are rotatably mounted at each of the work stations, are driven at a 3 to 1 ratio relative to the rotary turret. In other words, as the turret completes one full rotation about the column, each mandrel is rotated three times. As will be appreciated, 120° of travel by the turret represents the distance required to further form the can after the mandrels completely engage the can body. While in the preferred embodiment each mandrel makes one complete revolution through each 120° of travel of the rotary turret, it is possible to complete one full rotation of the mandrel in fewer degrees of travel by adjusting the ratio of the planetary gearing system. Doing so would subsequently impact the period of time during which the can bodies are loaded and unloaded from the embossing station.

Considering FIG. 6 in detail, the first mandrel 70 is supported within housing 90 for rotational movement facilitated by bearing means 121. The first member is "fixed" in the sense that it rotates about an axis that is in a fixed position with respect to the embossing station in which it is mounted. The fixed mandrel 70 supports a first tooling member 100. This tooling member 100 is also referred to as a female tooling member because of its configuration. The support shaft 88 includes a central bore 113 therethrough, extending from the rotary union 115 to the nose piece 117 of the female tooling member 100. Central bore 113 provides a passage through which pressurized air is provided to eject a can body from the female tooling subsequent to the completion of the embossing operation. A supply of pressurized air (not shown) is delivered through conduit means 119.

Turning to FIG. 7, the second or movable mandrel 76 is mounted for rotational movement about an axis 76*a* that reciprocates toward and away from the first or fixed mandrel 70. The movable mandrel 76 supports a second or male tooling member 200. The male tooling member 200 cooperates with the female tooling member 100 to effect the embossing of the side walls of the container. The female tooling member has a surface that defines one or more recessed portions therein and the male tooling member has a surface that defines one or more protuberances extending therefrom and adapted to correspond with the recessed portions of the female tooling. The continuous side wall of the can body is conveyed between the male and female tooling members in order to emboss features into the side wall of the can body in a manner to be described in detail below. A main pivot arm assembly 254 is supported for reciprocating rotational motion about the mains support shaft 256. The pivot arm assembly 254 is in fixed mechanical communication with a lever cam arm 258. At one end of the arm distal the second mandrel 76 is a cam follower 262. The cam follower is conveyed by means of the turret assembly 26, and follows along a cam surface 260 (shown in phantom in FIGS. 5 and 7) on the column. The cam surface mounted within the apparatus has a profile consistent clearance necessary to load and unload the can body from the fixed mandrel. The clearance is approximately 0.008 inches. The elevated portion of the cam profile is adapted to effect the reciprocal motion of the second, movable member toward and away from the fixed mandrel. As described above, the ratio of the rotation of the fixed mandrel with respect to the rotation of the turret about the column will impact the cam profile of the cam surface 260. Additionally, means can be provided to adjust the relative position of the pivot arm assembly 254 with respect to the lever cam arm 258 so as to adjust the ultimate position of the second or male tooling member 200 when it is in its pinch point position with respect to the female tooling member 100. The movable mandrel 76 is fixedly mounted onto shaft 264 which is supported at its upper and lower end by arms 266 and 268 which are extensions of the pivot arm assembly 254.

Figure 11:
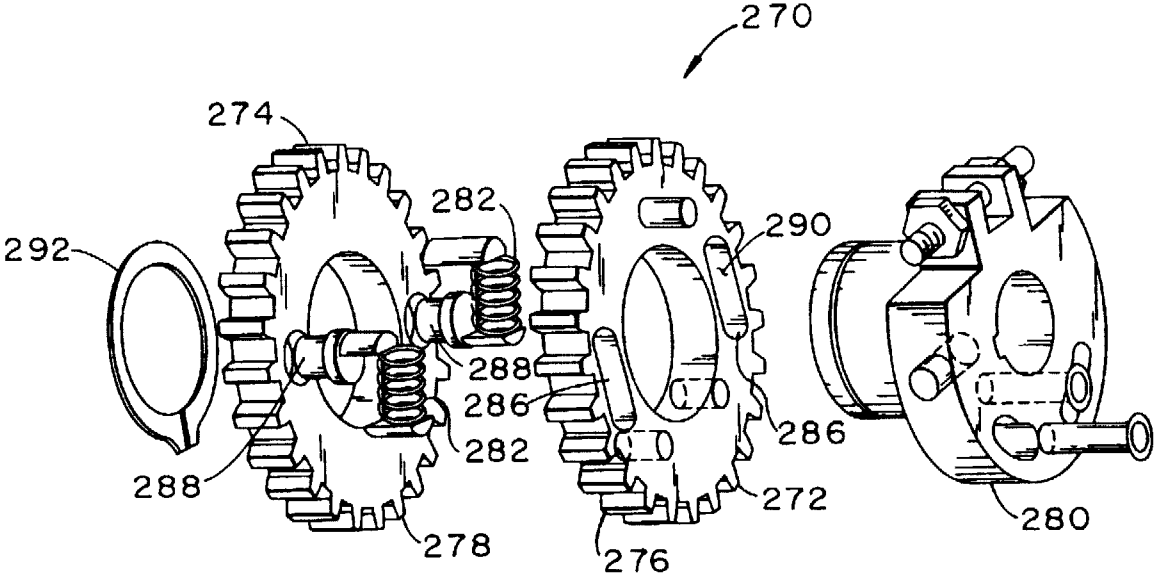
FIG. 11 is an exploded view of the anti-backlash gear assembly, all according to the instant invention.

At the uppermost end of shaft 264 is mounted an anti-backlash assembly 270. The anti-backlash assembly 270 as shown more clearly in FIG. 11 includes first and second gear member 272 and 274 that have substantially identical gear teeth 276 and 278 respectively Gear member 272 is keyed to the hub 280 and fixedly attached to the shaft 264 so that rotation of the gear 272 effects the rotation of the male tooling member 200. The anti-backlash assembly 270 functions as a spur gear that is in mechanical communication with the spur gear 120 on the shaft 88 of the fixed mandrel 70. Rotation of the first mandrel 70 through the planetary gear arrangement described elsewhere herein effects the rotation of the spur gear 120 which in turn is in mechanical communication with the anti-backlash assembly 270 of the movable mandrel 76. This gearing arrangement maintains the uniform rotation of the fixed and movable mandrels as the embossing station with which they are associated is conveyed by the turret around the column.

In the anti-backlash assembly, the second gear member 274 is mounted for limited rotational movement with respect to first gear member 272 on shaft 264. Once the anti-backlash assembly 270 is engaged with spur gear 120, rotational displacement of the second gear 274 with respect to the fixed, first gear 272 is effectively limited to the pitch of the teeth in gear member 120. The gear assembly 270 includes a biasing means such as spring members 282 mounted between the gears 272 and 274. Slots 286 are provided in the face of gear 272 and spring support posts 288 extend from the face of gear 274 into slots 286. The spring members 282 are compressed between the spring support posts 288 and the side walls 290 of slots 286. Retaining ring 292 retains the second gear 274 on the shaft 264. When assembled, the anti-backlash assembly urges the teeth 276 of gear 272 and the teeth 278 of gear 274 into a rotationally spaced or misaligned relationship with respect to each other. The result is that the effective pitch of the gear assembly, that is, the distance between one point on a gear tooth and the corresponding point on the next gear tooth as measured parallel to the axis of the gear assembly, has been reduced. When the movable mandrel 200 is in a position proximate the fixed mandrel 100, the anti-backlash gear operates as a standard spur gear. As the movable mandrel reciprocates to the position distal the fixed mandrel 100, the biasing means 282 of the anti-backlash assembly 270 urges the second gear member 274 out of alignment with first gear member 272, reducing the relative pitch between the teeth 274 of the first member and the teeth 276 of the second gear member. With the antibacklash gear in this "'open" position, the relative rotational position of the first mandrel with respect to the second mandrel is maintained. As the second mandrel reciprocates back toward the first mandrel, the first and second gear members 272 and 274 are urged back into alignment by the fixed pitch of the teeth of the spur gear of the fixed mandrel. The spring loading of the antibacklash gear member maintains the timing between the mandrels. The spur gears on the male and female mandrels move apart, but never completely separate. It is to be appreciated that the reciprocal motion of the second mandrel from the first mandrel need only be enough to provide the clearance necessary to load and to unload the can body from the female tooling of the first or fixed mandrel. In that the current thickness of a can body is approximately 0.004 to 0.006 inches thick, the clearance necessary to load the can body onto the mandrel is relatively small.

After the can has made one revolution through the male and female tooling so as to emboss the can with a full 360° of embossing, the can is removed from the female tooling. To assist in the removal or unloading, compressed air is provided through the female mandrel as described elsewhere herein. The triggering of the air feed can be done by mechanical switching that reflects the relative position of the turret station with respect to the embossing process. As the compressed air ejects the can from the mandrel and towards the loading mechanism of the lift pad assembly, the vacuum supply to the lift pad is applied to recapture the can. The lift pad maintains vacuum on the bottom of the can while lowering the can to its original height for discharge from the embossing apparatus. As illustrated in FIG. 1, the lift pad continues its rotation with the turret depositing the can onto a discharge wheel or similar discharge apparatus.

Figure 8B:
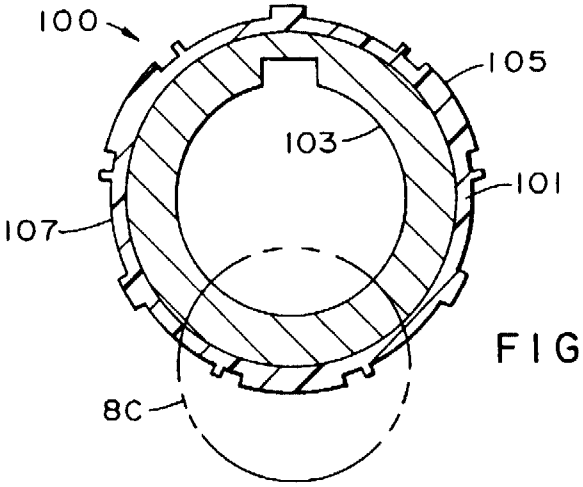
FIGS. 8A, 8B, and 8C are side elevation, sectional, and partial detail views of the female tooling of this invention.
Figure 8C:
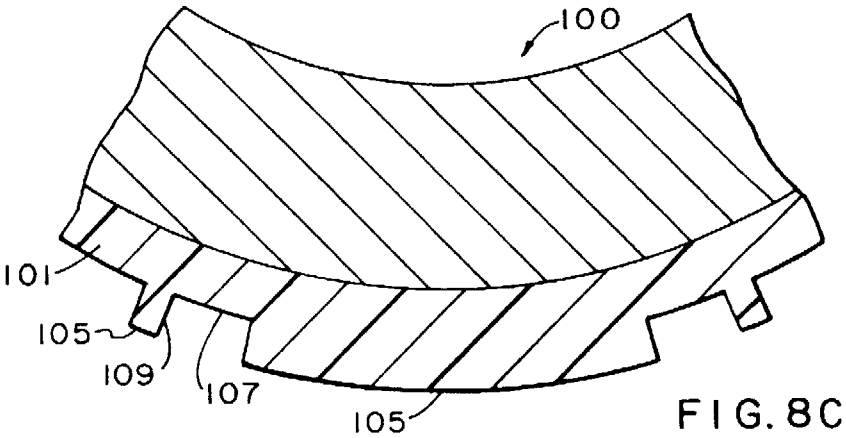
Figure 8A:
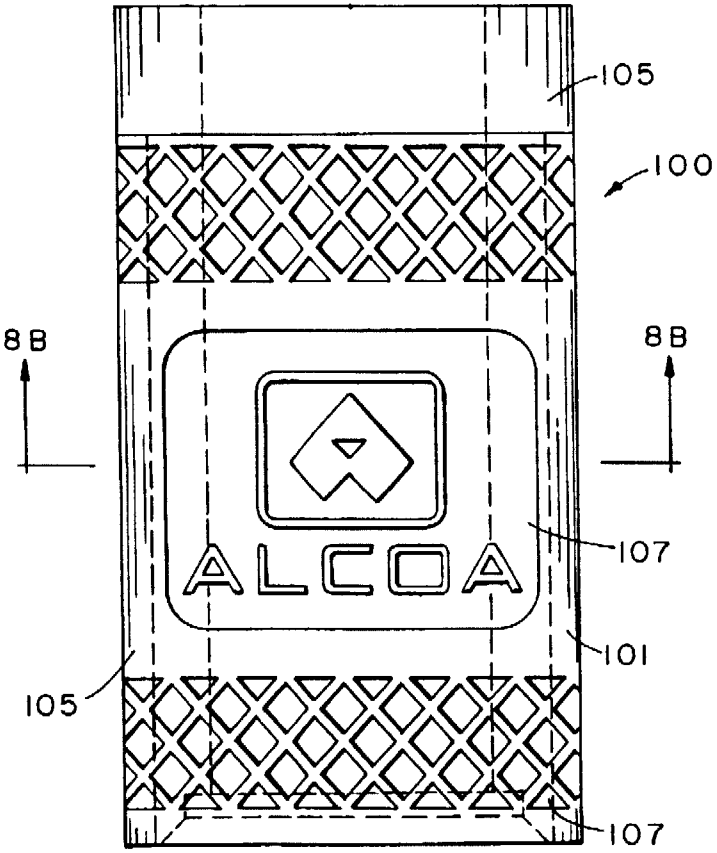

Turning to FIGS. 8, 9, and 10, the female and male tooling 100 and 200 respectively are shown in greater detail. Both the male and female tooling members are made preferably from a polymer material such as polyurethane that exhibits desirable wear and acceptable formability characteristics. Considering first FIGS. 8A, 8B, and 8C, there is illustrated a female tooling member 100 with a cylindrical body portion 101. As can be seen in FIG. 8B, the cylindrical body 101 has a central bore 103 therethrough that is adapted to cooperate with the support shaft 88 (FIG. 6) of the first mandrel 70 for the mounting of the tooling there on. The maximum outside diameter of the female tooling member is slightly less than the inside diameter of the can body to be inserted onto it for embossing. The outside diameter of the tooling is defined by the outer most surface 105 of the cylindrical body 101. Numerous reliefs 107 are made in the surface of the cylindrical body. As portions of the surface material are removed from the cylindrical body, a pattern can be formed in the tooling member. One exemplar of such a pattern is shown in FIG. 8A in which the trademarks of the assignee are present on the female tooling. The female tooling is in a sense the equivalent to a positive image in photography. The pattern shown in FIG. 8A is, as mentioned, only one example of the vast variety of configurations that can be produced in a female tooling member. It has been found that an appropriate method of forming the tooling is through the use of laser engraving. Extending between the surface 105 of the tooling member and the relief portion 107 are side wall portions 109.

Figure 9B:
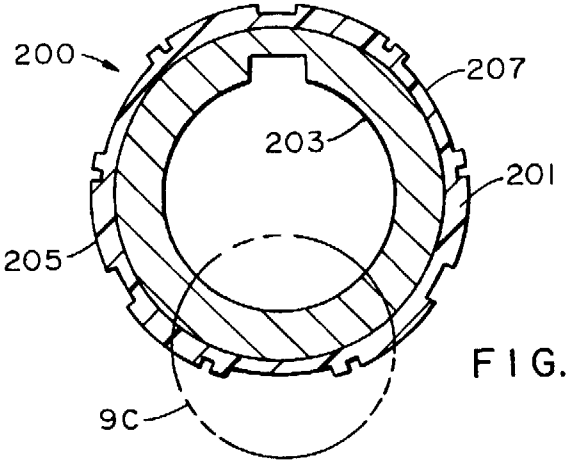
FIGS. 9A, 9B, and 9C are side elevation, sectional, and partial detail views of the male tooling of this invention.
Figure 9C:
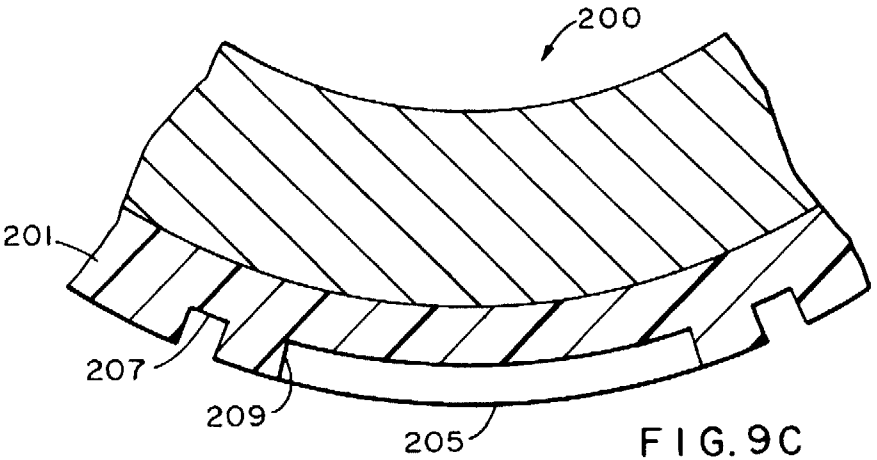
Figure 9A:
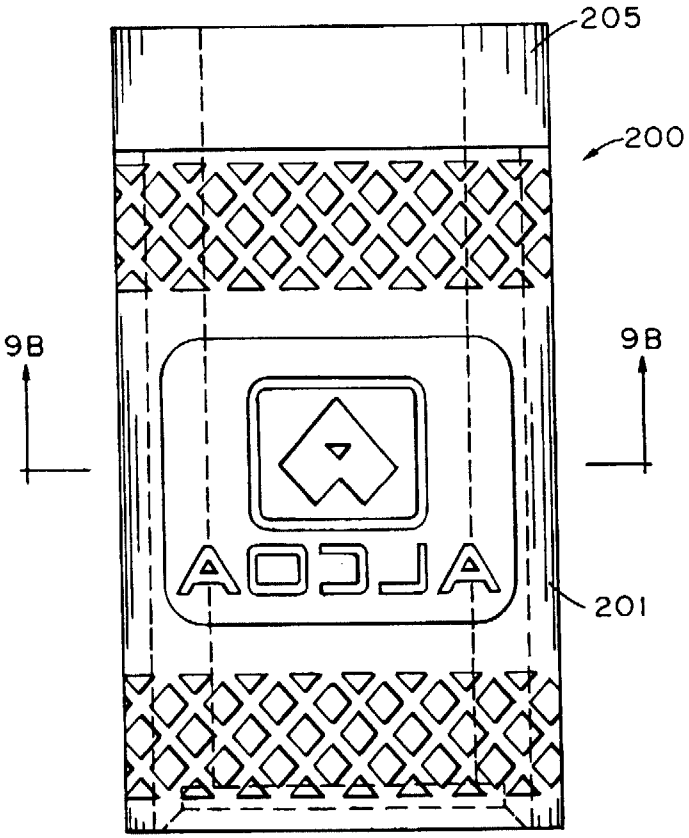
Figure 10A:
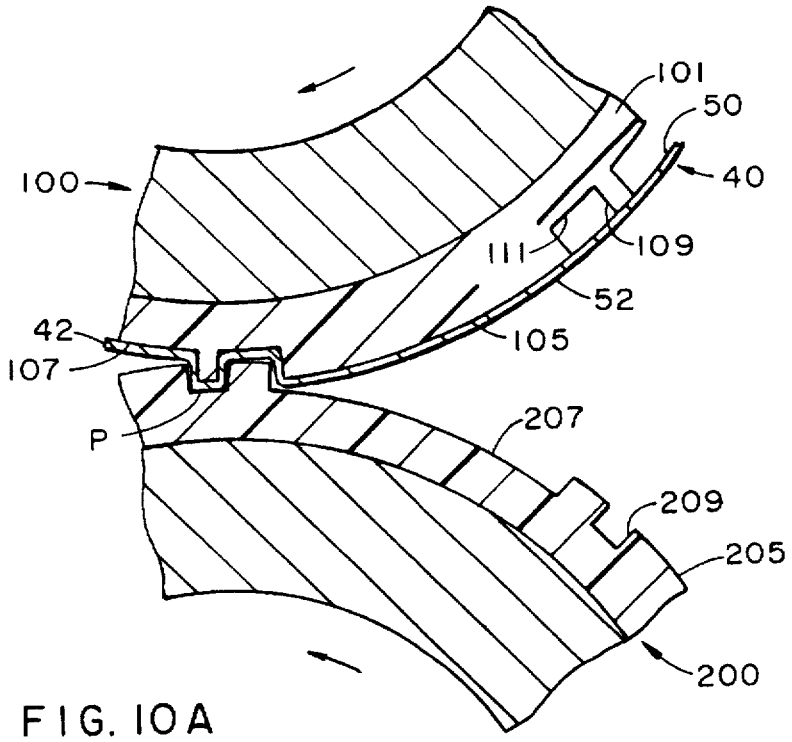
FIGS. 10A and 10B are cross sectional views of a portion of the tooling illustrated in FIGS. 8 and 9 engaging a can body for the embossing thereon.
Figure 10B:
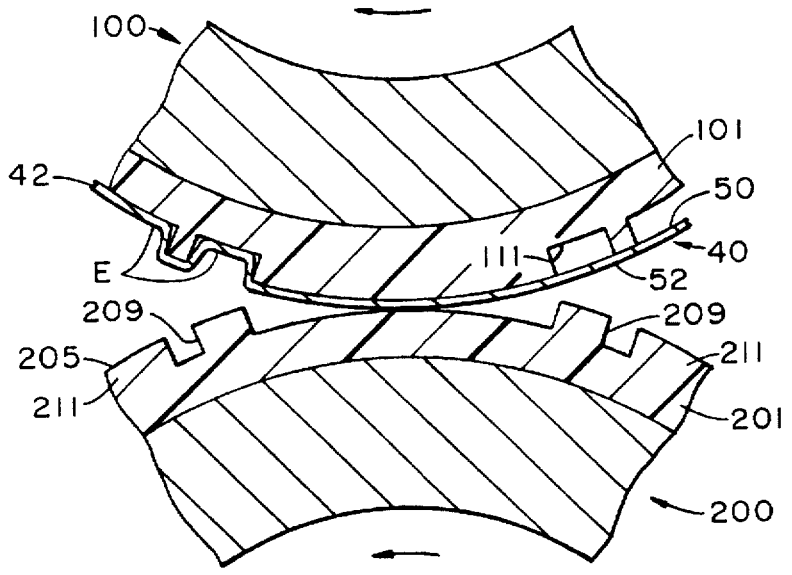

Turning to FIGS. 9A, 9B, and 9C, male tooling member 200 comprises a cylindrical body portion 201 having therein a central bore 203 adapted for mounting the cylindrical tooling member onto the shaft 264 of the reciprocating mandrel 76. The male tooling member is the equivalent of the negative in photography in that the appearance of graphics are reversed. This can be seen by the appearance of the lettering of the assignee's trademark in FIG. 9A. The male tooling member includes numerous protuberances 205 and relief portions 207. Extending there between are walls 209. Turning to FIGS. 10A and 10B, the manner in which the male and female tooling members cooperate to emboss a can body can be readily appreciated.

After a cylindrical container 40 is inserted over the female tooling member 100, the reciprocating mandrel presents the male tooling into a pinch point relationship with the female tooling. As shown in FIG. 10A, as the tooling members rotate with respect to each other, the female tooling member 100 is rotating in a clockwise direction as seen in FIG. 10A and the male tooling in a counterclockwise direction. The container side wall has a thickness of approximately 0.004 to 0.006 inches. This can be seen in FIG. 10A as the pinch point indicated by the reference character P embosses the container side wall 42. Sufficient clearance is provided between the male and female tooling member to allow the container side wall to be further formed by the tooling. The clearance also is sufficient to compensate for the pitch differential between the protuberances generally indicated by the reference character 211 in the male tooling and the recessed portions 111 of the female tooling member 100. Preferably, the protuberances of the male tooling member are approximately 0.010 inches reduced in all directions with respect to the corresponding recessed portions 111 of the female tooling member. In a preferred embodiment, the protuberances of the male tooling engage and emboss the container side wall to a depth of between 0.012 and 0.20 inches. It is believed that the combination of the clearance described above and the use of a polyurethane tooling provides sufficient clearance between the tooling members so as to avoid unnecessary strain on either the container's side wall during the embossing operation or the tooling members'features, i.e., the recessed portions and the protuberances.

The inventors have found that a container that has further formed side walls in accordance with the tooling of this invention is capable of withstanding the internal pressures typically associated with carbonated beverages. Moreover, even while under such pressures, the further formed can of this invention retains embossed features of the container side wall. In other words, the embossed features remain visible and pronounced to the touch, even while the contents of the container are under pressure. Another feature resulting from the tooling of this invention is that the portions of the container side wall proximate the embossed locations creates the appearance of being a raised portion of the container side wall. The result is a multi-dimensional effect on the container that presents a pleasing and attractive surface appearance of the container to the consuming public. A variety of embossed features as indicated by the reference character E on FIG. 10B can be incorporated into a can body to provide a can body that has the appearance of the female tooling member illustrated in FIG. 8A. It is to be appreciated that by modifying the relative depth of a relief portion on a female tooling member while increasing the relative height of a corresponding protuberance in the male tooling, a multi-dimensional embossing effect to container side wall is possible. Thus certain features may be more or less pronounced according to the depth and height of the tooling features, rendering a distinctive packaging product.

What has been described is an apparatus for the embossing of the side wall of a container. While the foregoing invention has been described and illustrated with specific embodiments, it will be understood that the inventions entitled to protection within the full scope of the appended claims.

Having described the invention, what is claimed is:

1. An apparatus for the application of decorative embossed features onto a can body with a cylindrical side wall, said cylindrical side wall having a public side and a product side opposite thereto, said product side defining the inside diameter of said can body, said apparatus comprising:

a first mandrel with a first tooling member adapted to receive thereon a can body; said first tooling member having a first cylindrical surface, said first cylindrical surface having an outside diameter that is slightly less than the inside diameter of said can body, said first cylindrical surface defining one or more recessed portions therein;

a second mandrel with a second tooling member reciprocally movable from a first position distal said first tooling member to a second position proximate said first tooling member wherein in said second position, the can body side wall is engaged between said first tooling member and said second tooling member, said second tooling member having a second cylindrical surface defining one or more protuberances extending therefrom and adapted to correspond with said recessed portions; such that each individual said protuberance has a corresponding recessed portion;

said first mandrel and second mandrel being in mechanical communication throughout the reciprocal movement of the second mandrel such that the first and second tooling members rotate continuously and synchronously with respect to each other, maintaining a substantially constant relative position between said recessed portions and said protuberances, wherein the continuous side wall of the can body is conveyed between the first and second tooling members which in combination define a pinch point with said side wall and at which pinch point, the decorative embossed features are formed into the side wall of the can body so as to extend from the product side of the side wall, wherein the outside diameter of said first cylindrical surface is slightly less than the inside diameter of said can body such that when said can body is received on the tooling member, one complete revolution of the tooling member conveys substantially the entire cylindrical side wall of the can body through the pinch point.

2. The apparatus according to claim 1 including means for controlling the reciprocal movement of the second tooling member between the first position distal the first tooling member and the second position proximate the first tooling member.

3. The apparatus according to claim 2 wherein the first and second tooling members define a first and second axis about which they rotate and each said axis includes a spur gear wherein the spur gears are in mechanical communication throughout the reciprocal movement of the second mandrel such that the first and second tooling members rotate continuously with respect to each other.

4. The apparatus according to claim 3 wherein one of said two spur gears is an anti-backlash gear, said anti-backlash gear comprising a first gear member and a second gear member, one of which gear members is fixed relative to the second tooling member to effect the rotational movement thereof and the other of which gear members is independently movable with respect thereto, and wherein said first gear member and said second gear member are spring biased with respect to each other.

5. The apparatus according to claim 4 wherein said anti-backlash gear is mounted for rotation about the second axis and as the second tooling member reciprocates away from the first tooling member, the anti-backlash gear maintains the constant rotational relationship of the first and second tooling members with respect to each other.

6. The apparatus according to claim 2 wherein the first tooling member has a surface that defines one or more recessed portions therein and the second tooling member has a surface that defines one or more protuberances extending therefrom and adapted to correspond with said recessed portions, wherein the continuous side wall of the can body conveyed between the first and second tooling members forms embossed features into the side wall of the can body.

7. The apparatus according to claim 2 wherein the first tooling member and the second tooling member define a first embossing station mounted in a rotatable turret and said rotatable turret includes at least a second embossing station.

8. The apparatus according to claim 1 including means for loading the can body onto the first tooling member and means for unloading the further formed can body from the first tooling member.

9. The apparatus according to claim 8 wherein the means for loading and means for unloading the can body onto and from the tooling member is a cam activated lift platform that is in mechanical communication with the turret means.

10. The apparatus according to claim 9 including means for presenting the can body to the lift platform wherein said presenting means selectively presents an individual can body to the lift platform.

* * * * *